US008244154B2

(12) United States Patent
Ito et al.

(10) Patent No.: US 8,244,154 B2
(45) Date of Patent: Aug. 14, 2012

(54) RECYCLING METHOD OF TONER CONTAINER

(75) Inventors: Takahiro Ito, Osaka (JP); Katsuaki Ohnishi, Osaka (JP); Hideaki Takeuchi, Osaka (JP); Shinji Otani, Osaka (JP)

(73) Assignee: Kyocera Mita Corporation (JP)

( * ) Notice: Subject to any disclaimer, the term of this patent is extended or adjusted under 35 U.S.C. 154(b) by 421 days.

(21) Appl. No.: 12/575,064

(22) Filed: Oct. 7, 2009

(65) Prior Publication Data

US 2010/0092207 A1 Apr. 15, 2010

(30) Foreign Application Priority Data

Oct. 14, 2008 (JP) ..... 2008-265152

(51) Int. Cl.
*G03G 15/00* (2006.01)

(52) U.S. Cl. ..... 399/109

(58) Field of Classification Search ..... 399/109, 399/262; 222/DIG. 1, 562, 563; 347/86
See application file for complete search history.

(56) References Cited

U.S. PATENT DOCUMENTS 5,983,059 A * 11/1999 Oka et al. ..... 399/262
6,219,506 B1 * 4/2001 Morinaga et al. ..... 399/109
6,246,848 B1 * 6/2001 Morinaga et al. ..... 399/106
7,486,905 B2 2/2009 Nishimura et al.

FOREIGN PATENT DOCUMENTS

JP 2006208837 A * 8/2006

* cited by examiner

*Primary Examiner* — Robert Beatty
(74) *Attorney, Agent, or Firm* — Gerald E. Hespos; Michael J. Porco

(57) ABSTRACT

A method is provided for recycling a toner container including a casing configured to house a toner, a sleeve protruding from the casing, and one cap with a brim to be bonded with a distal edge of the sleeve to be closed comprising: removing an area including an interface between the brim and the distal edge to form a new distal edge on the sleeve; removing a part of the one cap remaining in the sleeve; filling a toner in the casing; fitting another cap into the sleeve so that the brim of the another cap comes in contact with the new distal edge; and bonding the new distal edge and the brim of the another cap.

12 Claims, 8 Drawing Sheets

RECYCLING METHOD OF TONER CONTAINER

BACKGROUND OF THE INVENTION

1. Field of the Invention

The present invention relates to a method for recycling an empty toner container after the toner has been consumed.

2. Description of the Related Art

A recycling methods applied to a toner container for supplying a toner to a development apparatus provided to an image formation apparatus generally provide an old empty toner container in which toner has been consumed with an opportunity to be reused after the empty toner container is replaced with a new toner container, so that a user does not have to dispose the old toner container.

Among the recycle processes, it may be the most difficult to remove a cap of the toner container. The cap is mounted in a cylindrical opening defined in the main body of the toner container so that toner is filled in the main body through the opening. Adhesive may be applied between the distal end surface of the cylindrical toner filling port and the brim of the cap in order to prevent the leakage of the toner. The application of the adhesive, however, complicates the removal of the cap from the toner container.

Cutting the cylindrical toner filling port without interfering with the cap may be one approach to make the cap removal easy. This technology does not require the process of pulling out the cap from the toner filling port. Thus, this technology results in the efficient removal of the cap from the toner filling port. This method is not directed to numerous times of recycling the toner container because the cylindrical toner filling port will be shorted with the cutting process. Accordingly, even if the portions other than the toner filling port are still recyclable, the toner container has to be disposed after a few times of recycle.

A protrusion on the distal edge of the cylindrical toner filling port may be another approach to make the cap removal easy. This protrusion prevents the surface contact between the brim of the cap and the distal edge of the toner filling port. Consequently, a gap is formed between the brim of the cap and the distal edge of the toner filling port. The user may insert a tool in this gap to remove the cap from the toner filling port. This technology, however, does not still sufficiently facilitate the removal operation of the cap from the toner container.

In order to avoid an application of the adhesive between the cap and the toner filling port, an elastically deformable cap may also be used. The resilience of the cap to be fitted into the toner filling port may result in a sufficient seal between the cap and the toner filling port. On the other hand, the resilience of the cap may result in great frictional force between the cap and the toner filling port, and complicate the removal of the cap from the toner container.

SUMMARY OF THE INVENTION

Thus, an object of the present invention is to provide a method to recycle the toner container numerous times with facilitating the removal of the cap from the toner container.

The method for recycling a toner container according to one aspect of the present invention is applied to a toner container including a casing configured to house a toner, a sleeve protruding from the casing, and one cap with a brim to be bonded with a distal edge of the sleeve to be closed. This method includes removing an area including an interface between the brim and the distal edge to form a new distal edge on the sleeve; removing a part of the one cap remaining in the sleeve; filling a toner in the casing; fitting another cap into the sleeve so that the brim of the another cap comes in contact with the new distal edge; and bonding the new distal edge and the brim of the another cap.

Other objects and specific advantages that are obtained from the present invention will become more apparent from the explanation of the following embodiment.

DETAILED DESCRIPTION OF THE PREFERRED EMBODIMENTS

An embodiment of the present invention is now explained with reference to the accompanying drawings. The terms representing directions such as "up", "down," "left" and "right" in the ensuing explanation are just used in order to simplify the explanation, and do not limit the present invention in any way.

Figure 1:
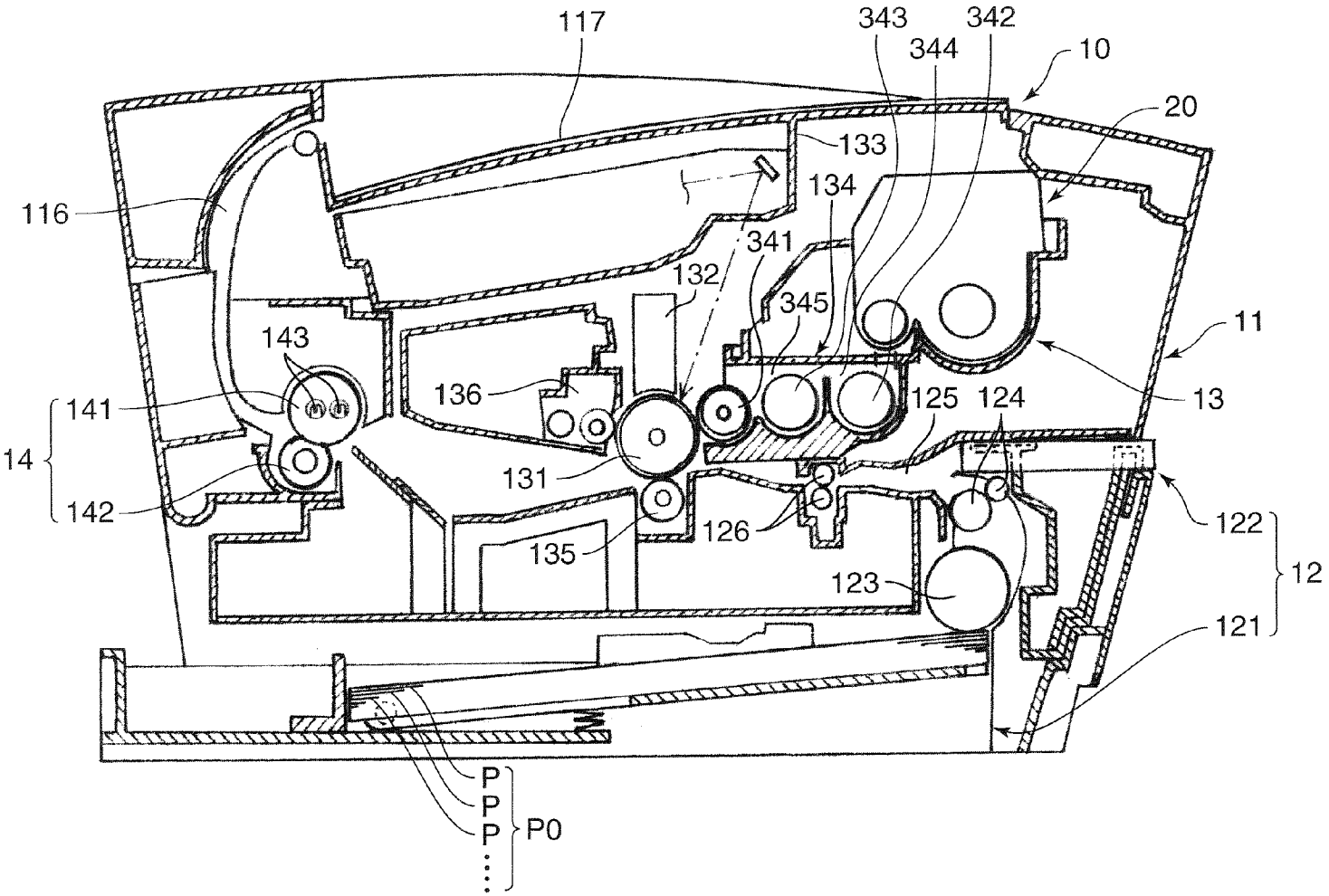
FIG. 1 is a diagram showing the internal structure of a printer comprising the toner container to which the method according to an embodiment of the present invention is applied.

FIG. 1 is a diagram showing the internal structure of a printer comprising the toner container to which the method according to an embodiment of the present invention is applied.

The printer (image formation apparatus) 10 comprises a main body 11. The main body 11 includes a paper feed part 12. The paper feed part 12 includes a cassette 121 for storing a stack of sheets P (sheet stack P0) to be subject to print processing, and a manual paper feed part 122 provided on the upper side of the cassette 121. The user may also manually feed the paper with the manual paper feed part 122. The cassette 121 is configured to be inserted into and removed from the main body 11. The main body 11 comprises a paper feed roller 123 in a larger diameter disposed at the downstream edge of the cassette 121 (right end of the cassette 121 in FIG. 1), a pair of carrier rollers 124 in a smaller diameter disposed immediately above the paper feed roller 123, a pair of resist rollers 126 positioned at the downstream side of the pair of carrier rollers 124, and a paper path 125 extending between the pair of carrier rollers 124 and the pair of resist rollers 126. The paper feed roller 123 feeds into the printer 10, one by one, the uppermost sheet P in the sheet stack P0 stored in the cassette 121. Subsequently, the pair of carrier rollers 124 convey the sheet P toward the pair of resist rollers 126.

Provided inside the main body 11 are an image formation part 13 for transcribing the toner image on the sheet P supplied from the paper feed part 12, and a fixation part 14 for fixing the toner image onto the sheet P transcribed by the image formation part 13. The resist roller 126 feeds the sheet P toward the image formation part 13. The image formation part 13 includes a rotatable photoconductor drum 131 (the rotating axis of the photoconductor drum 131 extends in an orthogonal direction to the paper surface of FIG. 1), a charging unit 132 disposed immediately above the photoconductor drum 131, a development apparatus 134 disposed on the right side of the photoconductor drum 131, an exposure apparatus 133 disposed on the upper side of the charging unit 132. The exposure apparatus 133 is configured to irradiate a laser beam toward the peripheral surface of the photoconductor drum 131 between the charging unit 132 and the development apparatus 134. The image formation part 13 further includes a transcription roller 135 disposed on the lower side of the photoconductor drum 131, and a cleaning apparatus 136 disposed on the left side of the photoconductor drum 131. The charging unit 132, the development apparatus 134, the transcription roller 135 and the cleaning apparatus 136 are disposed along the peripheral surface of the photoconductor drum 131.

The photoconductor drum 131 illustrated in FIG. 1 rotates in the clockwise direction. The charging unit 132 uniformly charges the peripheral surface of the rotating photoconductor drum 131. FIG. 1 shows a corona discharge-type of charging unit 132 for applying charge to the peripheral surface of the photoconductor drum 131 from a wire (corona discharge), but the present invention is not limited thereto. For example, a roller-type of charging unit may be used in substitute for the corona discharge-type of charging unit 132. The roller-type of charging unit comprises a roller configured to apply charge to the peripheral surface of the photoconductor drum 131 while the roller contacts and rotates on the peripheral surface of the photoconductor drum 131.

The exposure apparatus 133 irradiates a laser beam with some intensity depending on the image data from an external apparatus such as a computer, to the peripheral surface of the rotating photoconductor drum 131. The laser beam removes the charge on the photoconductor drum 131. Accordingly, irradiation of the laser beam from the exposure apparatus 133 based on the image data forms an electrostatic latent image on the peripheral surface of the photoconductor drum 131.

The development apparatus 134 includes a toner container 20 for housing the toner. The toner container 20 is disposed on the upper side of the development apparatus 134. The toner container 20 may be configured to be detached from the development apparatus 134. The development apparatus 134 supplies the toner contained in the developer from the toner container 20 to the peripheral surface of the photoconductor drum 131. The toner adheres to the electrostatic latent image formed by the exposure apparatus 133. Consequently, a toner image corresponding to the electrostatic latent image is formed on the peripheral surface of the photoconductor drum 131. The toner image on the peripheral surface of the photoconductor drum 131 may be positively charged.

The resist roller 126 feeds the sheet P between the photoconductor drum 131 and the transcription roller 135. The transcription roller 135 applies a negative charge to the sheet P. Accordingly, the sheet P has an opposite charge with respect to the charge of the toner image. While the transcription roller 135 and the photoconductor drum 131 are pressing and nipping the sheet P, the toner image, which is positively charged, on the peripheral surface of the photoconductor drum 131 may be torn off toward the surface of the sheet P negatively charged. The toner image is thereby transcribed on the sheet P.

The cleaning apparatus 136 removes the toner remaining on the peripheral surface of the photoconductor drum 131 after the transcription processing to the sheet P. The peripheral surface of the photoconductor drum 131 is thereby cleaned. The cleaned peripheral surface of the photoconductor drum 131 moves toward the charging unit 132 once again. Thereafter, the subsequent image formation processing is performed to the cleaned peripheral surface of the photoconductor drum 131.

After passing between the photoconductor drum 131 and the transcription roller 135, the sheet P is fed to the fixation part 14. The fixation part 14 applies thermal energy to the sheet P after the transcription processing and fixes the toner image on the sheet P. The fixation part 14 includes a fixation roller 141, and a pressure roller 142 below the fixation roller 141. A conductive heating element 143 such as a halogen lamp is disposed in the fixation roller 141. The fixation roller 141 is thereby capable of applying thermal energy to the sheet P. The peripheral surface of the pressure roller 142 presses the peripheral surface of the fixation roller 141, whereby a nip is defined between the fixation roller 141 and the pressure roller 142. The drive source (not shown) connected to the fixation roller 141 rotates the fixation roller 141 in a clockwise direction. The pressure roller 142 rotates with following the fixation roller 141. While the sheet P passes between the fixation roller 141 and the pressure roller 142, the toner is melted on the sheet P because of the thermal energy from the fixation roller 141, and then the melted toner is fixed on the sheet P pressed against the peripheral surface of the fixation roller 141 by the pressure roller 142.

The printer 10 includes a catch tray 117 configured to partially define the upper surface of the main body 11, and a paper discharging path 116 extending between the catch tray 117 and the fixation part 14. After the toner is fixed, the sheet P passes through the paper discharging path 116 and is discharged to the catch tray 117.

Figure 2:
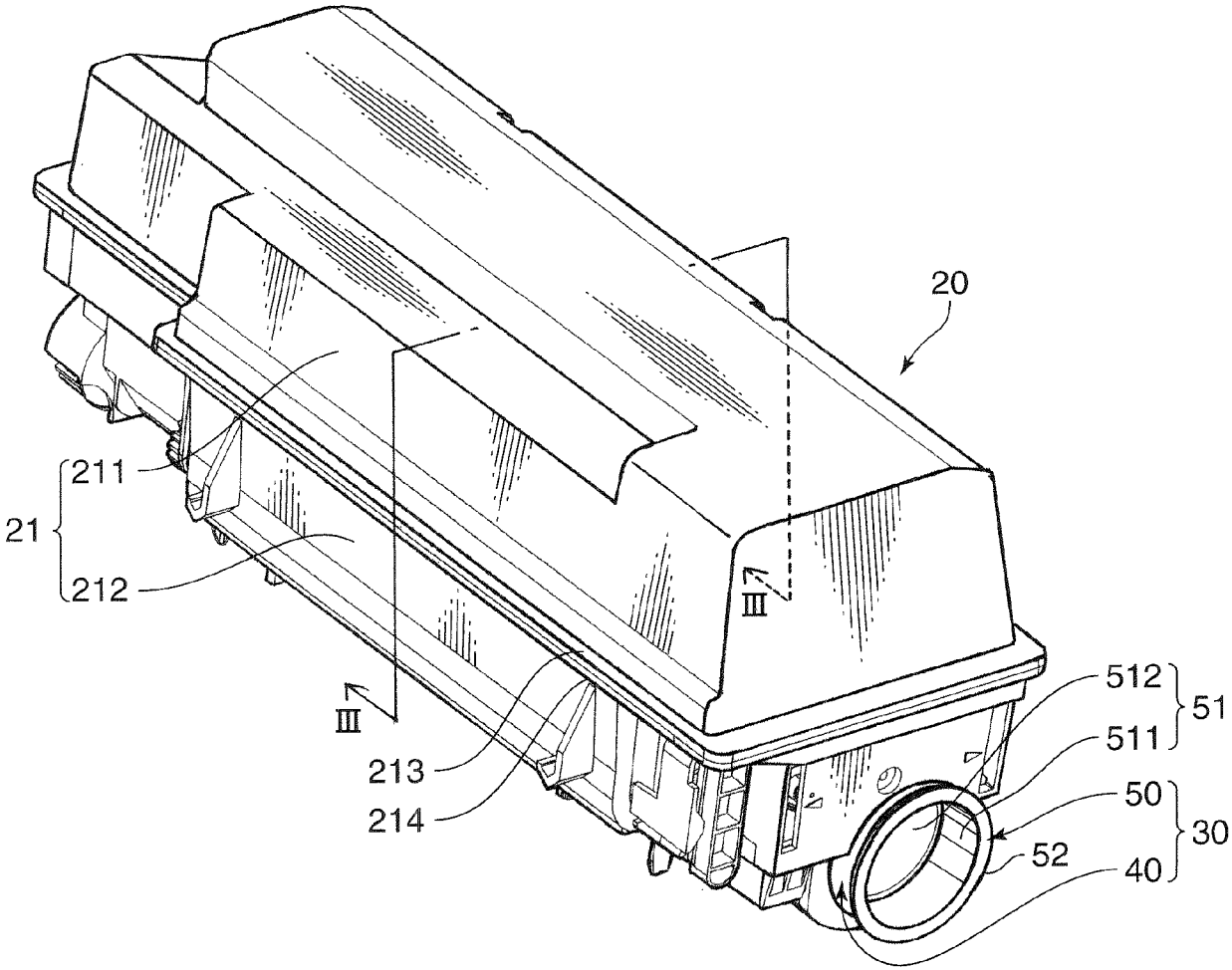
FIG. 2 is a perspective view of the toner container depicted FIG. 1.
Figure 3:
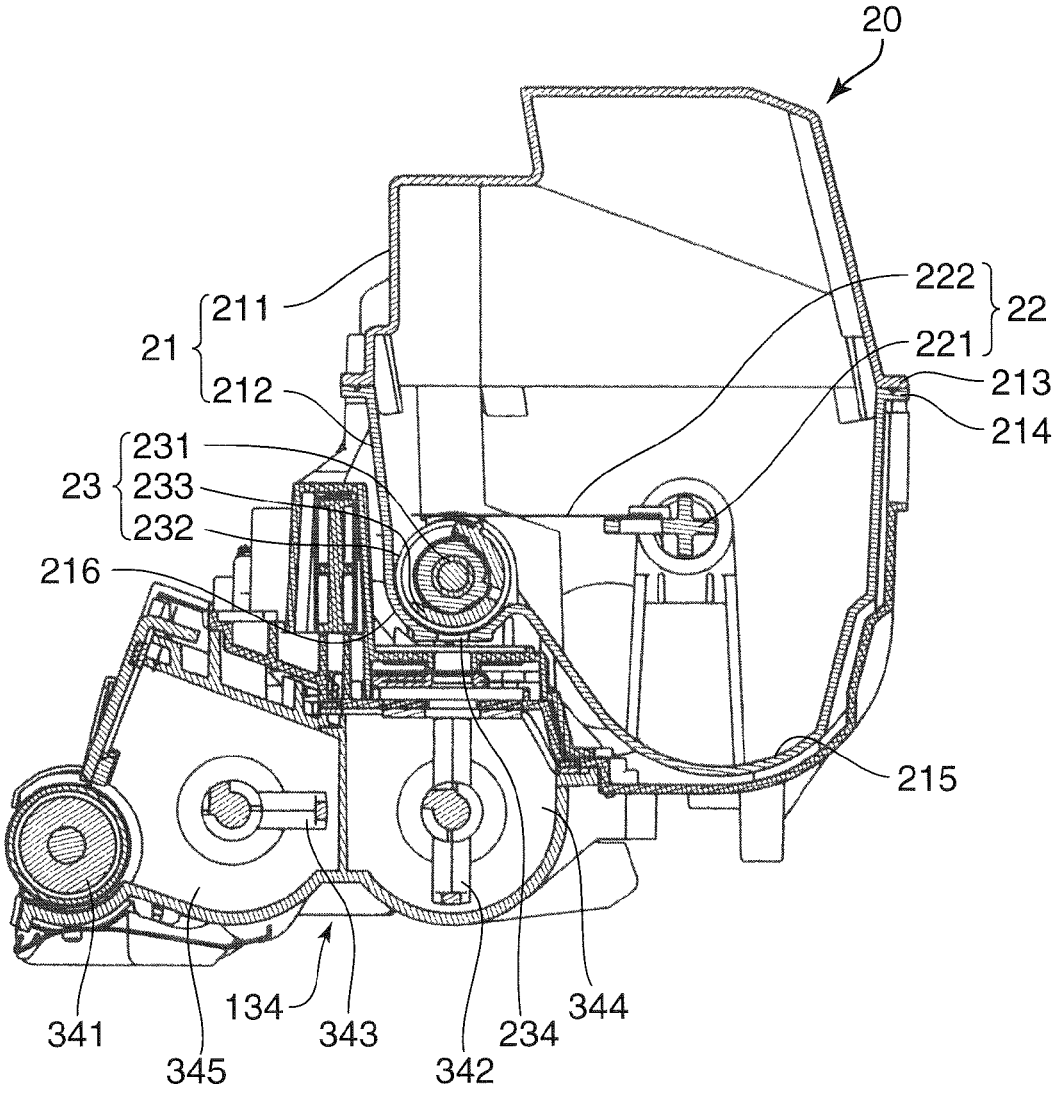
FIG. 3 is a cross sectional view of the toner container along line III-III depicted in FIG. 2.

FIG. 2 is a perspective view of the toner container 20 removed from the development apparatus 134 illustrated in FIG. 1. FIG. 3 is a cross-sectional view of the toner container 20 along line III-III in FIG. 2. FIG. 3 also shows the cross section of the development apparatus 134 to which the toner container 20 is mounted.

As shown in FIG. 2, the toner container 20 includes a substantially rectangular casing 21. An inlet port 30 is formed on a surface of the casing 21. The toner is filled in the casing via the inlet port 30. The inlet port 30 includes a cylindrical sleeve 40 having a proximal end to be connected to the casing 21, and a cap 50 to be fitted into the sleeve 40 so as to plug the sleeve 40.

The casing 21 includes an upper container 211, and a lower container 212 below the upper container 211. The upper container 211 includes an upper flange 213 which outwardly protrudes. The upper flange 213 defines the lower end opening of the upper container 211. The lower container 212 includes a lower flange 214 which outwardly protrudes. The lower flange 214 defines the upper end opening of the lower container 212. A contour shape of the upper flange 213 is substantially the same as that of the lower flange 214. The casing 21 is formed by overlapping the upper flange 213 and the lower flange 214. The upper flange 213 and the lower flange 214 may be bonded, for instance, with an adhesive, or welded. The upper flange 213 and the lower flange 214 form a strip portion surrounding the peripheral surface of the casing 21.

As shown in FIG. 3, the bottom part of the lower container 212 includes a first bottom plate 215, and a second bottom plate 216 formed on the left side of the first bottom plate 215. The first bottom plate 215 forms a semi-cylindrical bottom configured to occupy approximately ¾ of the width of the casing 21. The second bottom plate 216 forms a semi-cylindrical bottom configured to occupy approximately ¼ of the width of the casing 21. The arc diameter of the cross section of the first bottom plate 215 is larger than the arc diameter of the cross section of the second bottom plate 216.

As shown in FIG. 3, provided inside the casing 21 are an agitator 22 for agitating the toner, and a shutter 23 disposed on the left side of the agitator 22. The agitator 22 is disposed above the first bottom plate 215. The shutter 23 is disposed above the second bottom plate 216.

The agitator 22 comprises an agitation shaft 221 having a cross-shaped cross section. The agitation shaft 221 extends in the longitudinal direction of the casing 21 (the orthogonal direction to the paper surface of FIG. 3). The agitation shaft 221 may also be disposed at the center of curvature for defining the arc cross section of the first bottom plate 215 or closer to the center of curvature for defining the arc cross section of the first bottom plate 215. The agitator 22 further includes an agitation sheet 222 that radially extends from the agitation shaft 221. The agitation sheet 222 may be formed from an elastically deformable synthetic resin. The length from the center of the agitation shaft 221 to the distal end of the agitation sheet 222 may be longer than the curvature radius of the arc cross section of the first bottom plate 215. The agitation shaft 221 is connected to a drive motor (not shown). While the drive motor rotates the agitation shaft 221 and the agitation sheet 222, the distal end of the agitation sheet 222 slidably contacts the inner surface of the first bottom plate 215, and the toner in the casing 21 is thereby agitated.

The shutter 23 comprises a shutter shaft 231 extending in the longitudinal direction of the casing 21 (orthogonal direction to the paper surface of FIG. 3). The shutter shaft 231 may also be disposed at the center of curvature of the arc cross section of the second bottom plate 216 or closer to the center of curvature of the arc cross section of the second bottom plate 216. The shutter 23 further includes a screw feeder 233 integrally formed with the shutter shaft 231. The screw feeder 233 spirally surrounds the peripheral surface of the shutter shaft 231. The shutter 23 further includes a shutter cylinder 232 concentrically disposed to the shutter shaft 231. The shutter cylinder 232 houses the shutter shaft 231 and the screw feeder 233. The shutter cylinder 232 comprises a supply port 234 for supplying the toner to the development roller 341 of the development apparatus 134. The shutter shaft 231 is connected to a drive motor (not shown). The drive motor rotates the shutter shaft 231 and the screw feeder 233. The toner in the shutter cylinder 232 thereby moves toward the supply port 234.

The development apparatus 134 comprises a first chamber 344 communicating with the internal space of the casing 21 via the supply port 234, and a second chamber 345 adjacent to and communicating with the first chamber 344. A development roller 341 is disposed at the corner of the second chamber 345. As shown in FIG. 1, the development roller 341 is disposed adjacent to the photoconductor drum 131. The longitudinal axis of the development roller 341 extends in parallel with the longitudinal axis of the photoconductor drum 131. The toner which the screw feeder 231 sends toward the supply port 234 reaches the first chamber 344. The first chamber 344 comprises an agitator 342 extending in parallel with the longitudinal axis of the development roller 341. When the agitator 342 is rotated, the toner in the first chamber 344 moves to the second chamber 345 while being agitated. An agitator 343 is disposed in the second chamber 345. The toner in the second chamber 345 is supplied to the development roller 341 while being agitated with the agitator 343. The toner supplied to the development roller 341 is delivered to the photoconductor drum 131 according to the rotation of the development roller 341.

Figure 4A:
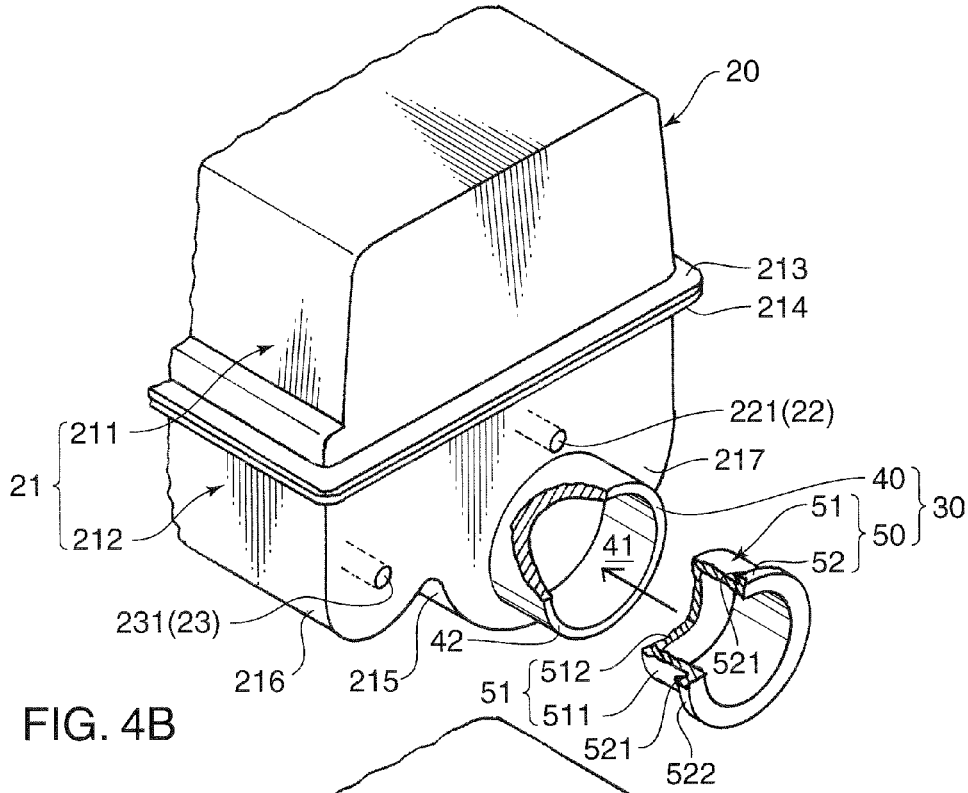
FIG. 4A is a perspective view showing the sleeve before mounting the cap of the toner container shown in FIG. 2.
Figure 4B:
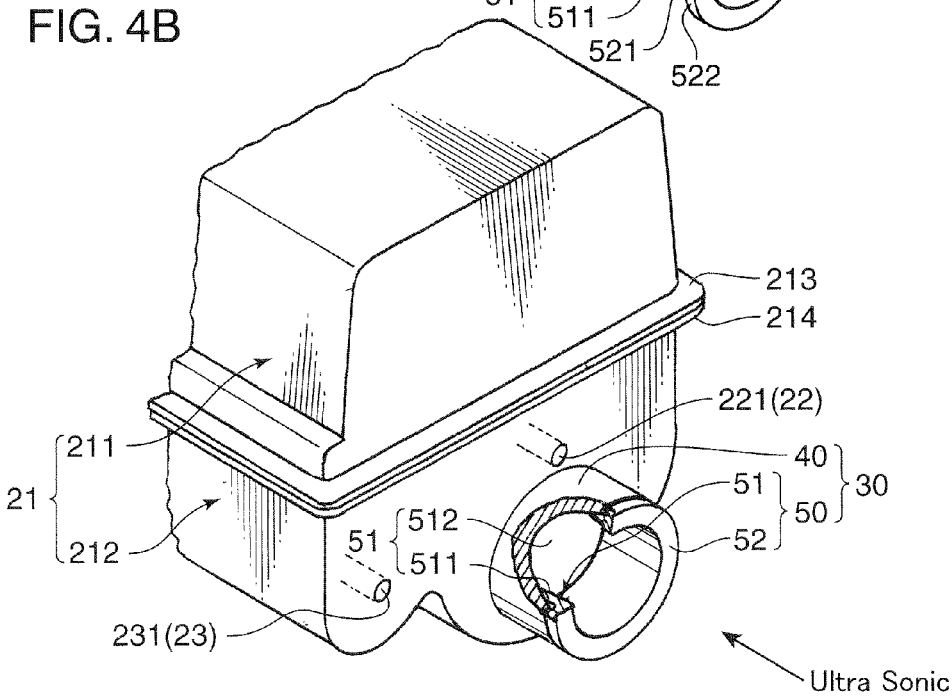
FIG. 4B is a perspective view showing the sleeve after mounting the cap of the toner container shown in FIG. 2.

FIG. 4A is a perspective view showing the inlet port 30 before the cap 50 is mounted. FIG. 4B is a perspective view showing the inlet port 30 after the cap 50 is mounted.

The sleeve 40 of the inlet port 30 protrudes outward from the front wall 217 defining the internal space of the lower container 212 together with the first bottom plate 215 and the second bottom plate 216. The sleeve 40 allows the internal space of the casing 21 to communicate with the outside between the first bottom plate 215 and the agitation shaft 221. The toner may thereby be smoothly filled in the casing 21 through the sleeve 40 without any interference of the agitation shaft 221.

The cap 50 includes a body part 51 that is complementary to the internal space of the sleeve 40, and a circular brim 52 radially protruding from the proximal end of the body part 51, which may be held by user's hand. The body part 51 includes a cylindrical insertion part 511 to be inserted into the sleeve 40, and a plug plate 512 for plugging the body part 51 (insertion part 511). The outer diameter of the insertion part 511 may be slightly smaller than the inner diameter of the sleeve 40 so that the overall peripheral surface of the insertion part 511 extending between the plugging plate 512 and the brim 52 comes in contact with the inner peripheral surface of the sleeve 40.

While the cap 50 is inserted into the sleeve 40, the brim 52 is in contact with the distal edge 42 of the sleeve 40. The outer diameter of the brim 52 may be equal to the outer diameter of the sleeve 40 (the protrusion of the brim 52 from the insertion part 511 may be equal to the thickness of the sleeve). Thus, while the cap 50 is inserted into the sleeve 40, the outer peripheral surface of the brim 52 and the peripheral surface of the sleeve may be leveled.

After fitting the cap 50 into the sleeve 40, ultrasonic waves are used to weld the brim 52 with the distal edge of the sleeve 40. The cap 50 is thereby fixed to the sleeve 40. As shown in FIG. 4B, the ultrasonic wave is emitted from the proximal end of the cap 50 and applied to the brim 52. The ultrasonic wave energy melts the surface 522 of the brim 52 in contact with the distal edge of the sleeve 40, and the distal edge of the sleeve 40 and the contact surface 522 of the brim 52 are bonded together.

Figure 4D:
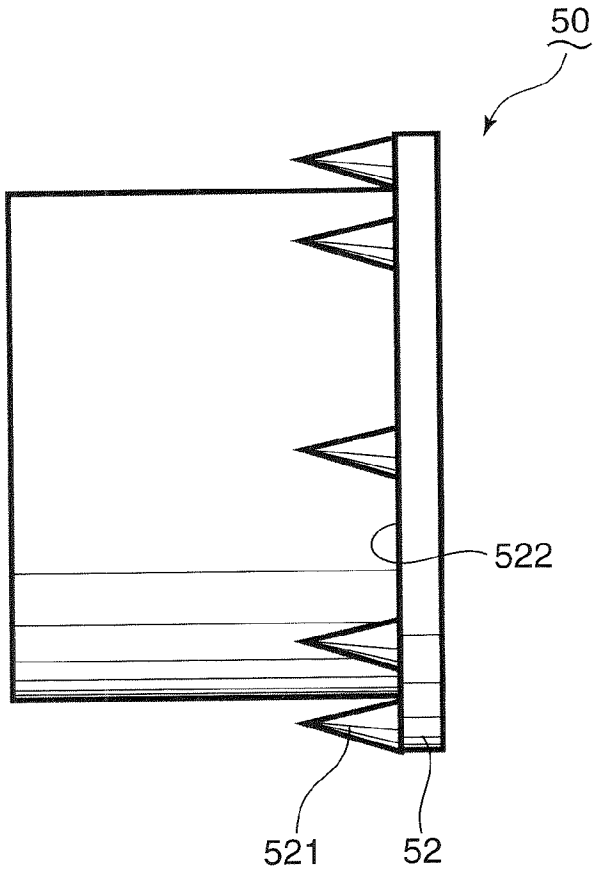
FIG. 4D is a side view of the cap of the toner container depicted in FIG. 2.
Figure 4C:
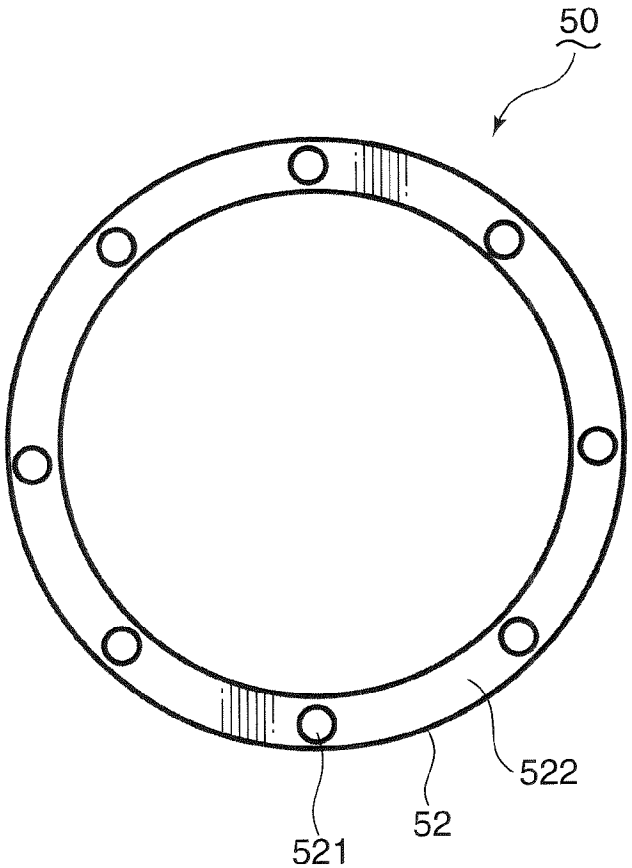
FIG. 4C is a diagram of the cap of the toner container depicted in FIG. 2 viewed from the proximal side.

FIG. 4C is a diagram of the cap 50 viewed from the front end side. FIG. 4D is a side view of the cap 50.

The brim 52 may comprise a plurality of conical protrusions 521 that protrude from the contact surface 522 toward the distal edge of the sleeve 40. The plurality of protrusions 521 are formed in even pitch along the circular contact surface 522. The protrusion 521 functions as an energy director, and concentrates the ultrasonic wave energy to the distal end of the protrusion 521 during the welding process using the foregoing ultrasonic wave. The efficiency of the welding process may thereby be enhanced.

Figure 5:
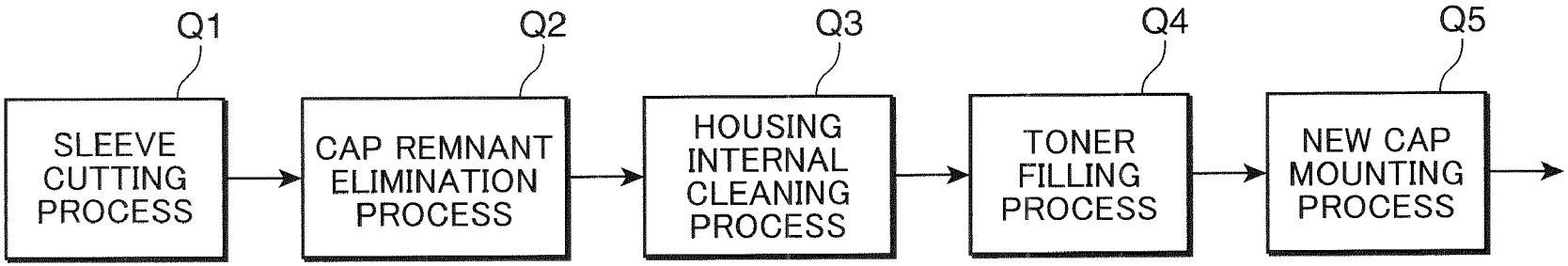
FIG. 5 is a flowchart explaining the method of recycling the toner container depicted in FIG. 2.

FIG. 5 is a flowchart explaining the method of recycling the toner container 20.

The recycling method of the toner container 20 includes a process (process Q1) of cutting the sleeve 40, a process (process Q2) of removing the portion of the cap 50 remaining in the sleeve 40 after cutting the sleeve 40, a process (process Q3) of cleaning the inside of the casing 21 after the remaining portion of the cap 50 is removed, a process (process Q4) of filling the toner in the cleaned casing 21, and a process (process Q5) of mounting a new cap on the casing 21 filled with the toner.

Figure 6A:
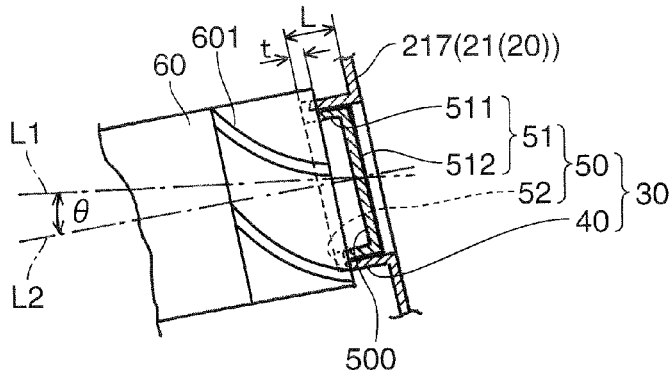
FIG. 6A is a diagram explaining process Q1 shown in FIG. 5.

FIG. 6A is a diagram explaining the process Q1.

The toner container 20 is mounted on the milling machine so that the axis L2 of the sleeve 40 tilts a prescribed angle (θ) with respect to the horizontal line L1 during the process Q1 (so that the distal end of the sleeve 40 is positioned to be lower than the proximal end of the sleeve 40 connected to the casing). It is thereby possible to prevent intrusion of cutting scrap that arises during the cutting of the sleeve 40 into the casing 21. The tilt angle θ (angle between the axis of the sleeve 40 shown by a dot-dash-line and horizontal line) within the range of 0° or greater and 90° or less may be preferable. The milling machine comprises an end mill 60 (milling tool). A cutting blade 601 is formed on the distal end of the end mill 60. The cutting blade 601 of the end mill 60 comes in contact with the brim 52 of the cap 50. As a result of rotating the end mill 60, the brim 52 and the distal edge of the sleeve 40 are cut. Consequently, the welded part between the brim 52 and the distal edge of the sleeve 40 may be removed, and the cutting plane of the sleeve 40 may become the new distal edge. In FIG. 6A, the cut brim 52, the proximal end of the insertion part 511 and the distal end of the sleeve 40 are represented with dotted lines. As shown in FIG. 6A, the new distal edge of the sleeve 40 is formed in a section L defined by the brim 52 and the plugging plate 512. After the brim 52 is removed, a part 500 of the cap 50 may remain in the sleeve 40. The tilt of the toner container 20 may prevent the remaining portion 500 of the cap 50 from entering into the casing 21. The remaining portion 500 of the cap 50 includes the plugging plate 512. The plugging plate 512 continues to plug the sleeve 40 before and after the cutting process Q1. Accordingly, the plugging plate 512 may prevent the movement of machining swarf into the casing 21 during or after the cutting process Q1.

In FIG. 6A, the symbol "t" represents the thickness to be cut. The thickness to be cut is defined as the distance from the proximal end of the cap 50 to the distal end of the end mill 60. When the thickness of the brim 52 is, for example, 1.5 mm, the thickness to be cut "t" may be set, for example, to 2.5 mm. Here, the distal end of the sleeve 40 may only be cut by 1 mm. Thus, after the process Q1, the protrusion of the sleeve 40 from the front wall 217 may be shorter by 1 mm in comparison to the protrusion before the process Q1. The decrease in the protrusion of the sleeve 40 by approximately 1 mm may not impair the function of the sleeve 40 (function for retaining the cap 50). Thus, in comparison to prior arts, the toner container 20 may be recycled numerous times. After the process Q1, the protrusion of the sleeve 40 from the front wall 217 may be measured in order for a user to identify how many times the toner container 20 has been recycled and/or how many times the toner 20 may be recycled in the future. Removal of the distal end (approximately 1 mm) of the sleeve 40 results in removal of the resin component welded with the cap 50. Consequently, in the process Q5 shown in FIG. 5, the welding process upon mounting the new cap 50 may be preferably executed. The process Q1 may further include a step of removing burr resulting from the cutting step of the process Q1. The removal of the resin component welded with the cap 50 may facilitate the removal of the burr, which adheres to the new distal edge of the sleeve 40 in many cases. Consequently, the cutting plane of the sleeve 40 may be much smoother, and, in the process Q5, the welding process to attach/fix the new cap 50 may be more preferably executed.

Figure 6B:
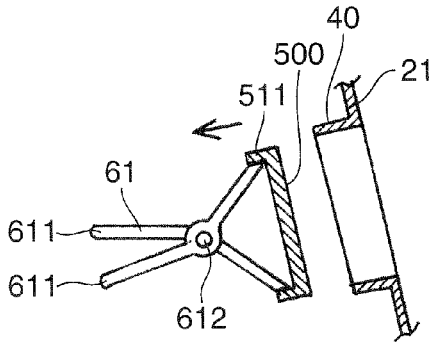
FIG. 6B is a diagram explaining process Q2 shown in FIG. 5.

FIG. 6B is a diagram explaining the process (process Q2) for removing the remaining portion 500 of the cap 50 in the sleeve 40.

An exclusive removal tool 61 is prepared for removing the remaining portion 500 of the cap 50 in the sleeve 40 after the cutting of the sleeve 40 in the process Q1. The structure of the removal tool 61 may be formed as scissors. The removal tool 61 includes a pair of L-shaped pieces 611, and a pin 612 disposed at the bend of both L-shaped pieces 611. The pin 612 rotatably connects both L-shaped pieces 611. After the distal end of the removal tool 61 is inserted into the remaining portion 500, both L-shaped pieces 611 are rotated around the pin 612. When the proximal ends of both L-shaped pieces 611 are brought close to each other, the distal ends of both L-shaped pieces 611 may move away from each other and come in contact with the inner wall surface of the insertion part 511 of the cap 50. Mutually opposing force applied from the distal ends of both L-shaped pieces 611 onto the inner wall surface of the insertion part 511 causes frictional force between the distal ends of both L-shaped pieces 611 and inner wall surface of the insertion part 511. As a result of moving the removal tool 61 toward the cutting end of the sleeve 40, the remaining portion 500 is pulled out from the sleeve 40.

Figure 6C:
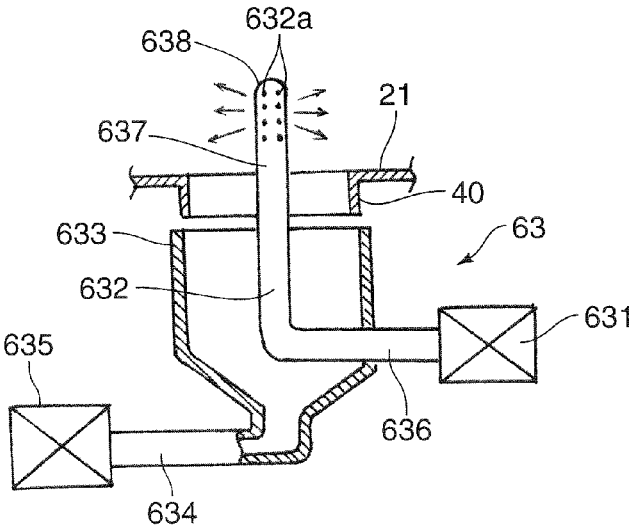
FIG. 6C is a diagram explaining process Q3 shown in FIG. 5.

FIG. 6C is a diagram explaining the process Q3 shown in FIG. 5. In the process Q3, the toner remaining in the casing 21 is removed, and the inside of the casing 21 is cleaned. The casing 21 is installed so that the distal end of the sleeve 40 of the casing 21 faces downward (so that the distal end of the sleeve 40 is positioned to be lower than the proximal end of the sleeve 40 connected to the casing 21) in the process Q3. Subsequently, the cleaning apparatus 63 is used to clean the inside of the casing 21. The cleaning apparatus 63 includes a compressor 631 for sending compressed gas and a supply pipe 632 inserted inside the casing 21 via the sleeve 40. The supply pipe 632 is configured to guide the compressed gas from the compressor 631 into the casing 21. The cleaning apparatus 63 further includes a funnel-shaped hopper 633 below the sleeve 40 through which toner drops. The hopper 633 catches the toner. Preferably, the upper end opening of the hopper 633 is larger than the outer diameter of the sleeve 40. The hopper 633 is downwardly tapered. The cleaning apparatus 63 further includes a discharge pipe 634 comprising one end to be connected to the lower end opening of the hopper 633, and a dust collection apparatus 635 (for instance, a bag filter) to be connected to the other end of the discharge pipe 634. The dust collection apparatus 635 includes a suction unit (not shown) such as a blower.

To mount the foregoing casing 21 on the hopper 633, the sleeve 40 of the casing 21 is inserted into the opening defined at the upper end of the hopper 633.

Here, the distal end of the supply pipe 632 may exist in the casing 21. The supply pipe 632 comprises a first tube 636 including a proximal end to be connected to the compressor 631 and a distal end to be disposed in the hopper 633, and a second tube 637 including a proximal end to be connected to the distal end of the first tube 636 and a distal end to be disposed in the casing 21. Numerous through-holes 632*a* are defined on the arc surface 638, which closes the distal end of the second tube 637, and/or the peripheral surface of the second tube 637 below the arc surface 638.

After the casing 21 is mounted on the hopper 633, compressed gas is introduced from the compressor 631 into the casing 21 and the dust collection apparatus 635 is activated. The compressed gas from the compressor 631 is discharged from the through-holes 632*a* of the second tube 637 and cleans the casing 21. The compressed gas from the compressor 631 additionally washes out the air in the casing 21 from the sleeve 40 toward the hopper 633. The toner in the casing 21 is carried by the gas flow directed toward the sleeve 40 and moves from the casing 21 to the hopper 633. The suction unit of the dust collection apparatus 635 sucks the gas in the casing 21 to facilitate the movement of the toner from the casing 21 to the hopper 633. The toner in the hopper 633 is further sucked with the dust collection apparatus 635 and moves toward the dust collection apparatus 635. The dust collection apparatus 635 collects the toner. The toner in the casing 21 is thereby purged, and the casing 21 may be as clean as a brand new casing 21.

Figure 6D:
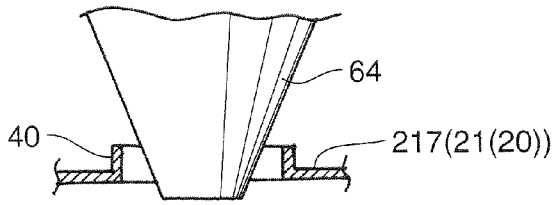
FIG. 6D is a diagram explaining process Q4 shown in FIG. 5.

FIG. 6D is a diagram explaining the process Q4 shown in FIG. 5. In the process Q4, the toner is filled in the cleaned casing 21. The casing 21 is installed so that the sleeve 40 protrudes upward in the process Q4. Subsequently, the funnel 64 is inserted into the sleeve 40. After the funnel 64 is mounted into the sleeve 40, the toner is filled in the casing 21 via the funnel 64.

Figure 7A:
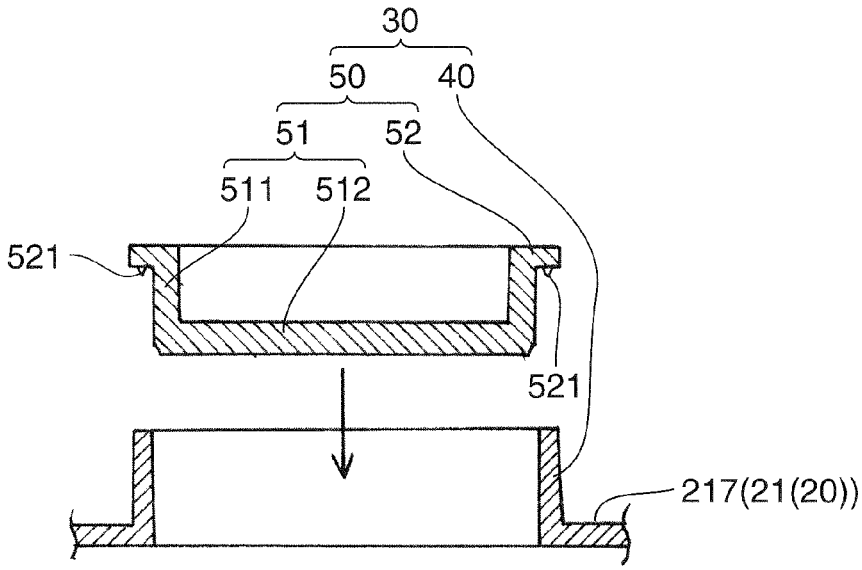
FIG. 7A is a diagram explaining process Q5 shown in FIG. 5, and shows the sleeve before the cap is mounted.
Figure 7B:
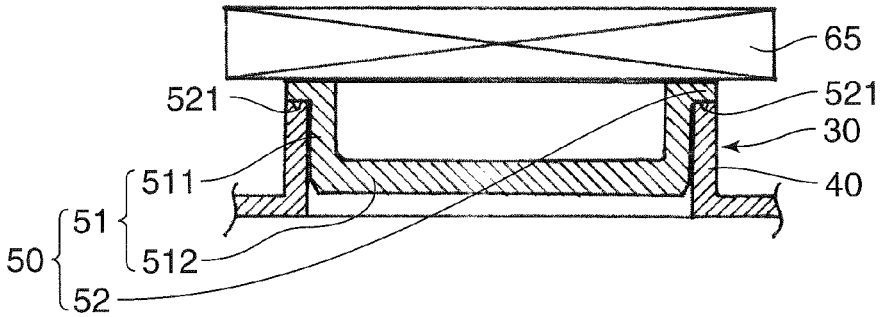
FIG. 7B is a diagram explaining process Q5 shown in FIG. 5, and shows the sleeve after the cap is mounted.

FIG. 7A and FIG. 7B are diagrams explaining the process Q5 shown in FIG. 5. FIG. 7A shows the sleeve 40 before the new cap 50 is mounted. FIG. 7B shows the sleeve 40 after the new cap 50 is mounted. After the toner is filled in the process Q4, the new cap 50 is mounted in the process Q5.

As described above, the new distal edge 42 is formed on the sleeve 40 in the process Q1. Moreover, the remaining portion 500 of the cap 50 is removed in the process Q2. Thus, as shown with the arrow in FIG. 7A, the new cap 50 may be fitted into the sleeve 40.

As shown in FIG. 7B, after the new cap 50 is mounted on the sleeve 40, the brim 52 of the new cap 50 comes in contact with the new distal edge of the sleeve 40. After that, the ultrasonic wave generator 65 is disposed on the cap 50. The ultrasonic wave generator 65 supplies ultrasonic waves to the welding portion between the brim 52 and the distal edge 42 of the sleeve 40 via the cap 50. While the ultrasonic wave generator 65 supplies ultrasonic waves, the energy of the ultrasonic waves is concentrated on the distal end of the conical protrusion 521 shown in FIG. 4C and FIG. 4D. Consequently, the resin of the cap 50 and/or the sleeve 40 around the protrusion 521 beings to melt, and the melting thereafter spreads to the other portions. A few moments later, the resin may melt across the entire boundary surface between the brim 52 and the distal edge of the sleeve 40, which are thereby welded.

As described above, the toner container 20 is recycled as a result of performing the processes Q1 to Q5 shown in FIG. 5.

The recycling method of a toner container according to the foregoing embodiment may be preferably applied to a toner container comprising a casing configured to house a toner, a sleeve protruding from the casing, and one cap with a brim to be bonded with a distal edge of the sleeve to be closed.

The recycling method of a toner container according to one aspect of the foregoing embodiment mainly comprises removing an area including an interface between the brim and the distal edge to form a new distal edge on the sleeve; removing a part of the one cap remaining in the sleeve; filling a toner in the casing; fitting another cap into the sleeve so that the brim of the another cap comes in contact with the new distal edge; and bonding the new distal edge and the brim of the another cap.

According to the foregoing feature, a new distal edge will be formed on the sleeve by removing the interface between the brim configured to prevent the leakage of the toner and the distal edge of the sleeve. Also removal of the interface results in easy removal of the cap by removing the remaining part of the cap. Accordingly, after the toner is filled and another cap is mounted on the sleeve, the brim of the cap and the sleeve distal edge may be preferably bonded together so as to prevent the leakage of the toner from the recycled toner container. In addition, the toner container may be recycled numerous times because just the interface is removed, which means that the sleeve may not be cut off unnecessarily too much.

In the foregoing feature, the one cap may include a surface for plugging the sleeve; and the step of removing the area including the interface between the brim part and the leading edge includes forming the new distal edge in a section defined between the brim part and the surface. Although the foregoing embodiment illustrates the sealing plate as the surface for plugging the sleeve, the present invention is not limited to the shape of the illustrated sealing plate. In the foregoing feature, the surface will continue to plug the sleeve while or after the brim and the distal edge are cut off. Thus, the surface prevents machining swarf caused by cutting the brim and the distal edge from moving into the casing.

In the foregoing feature, the step of removing the area including the interface between the brim and the distal edge may include positioning the distal edge at a position lower than a proximal end of the sleeve that is connected with the casing before cutting out the brim and the distal edge. According to the foregoing feature, machining swarf caused by cutting the brim and the distal edge may be prevented from moving into the casing.

In the foregoing feature, the step of removing the area including the interface between the brim part and the distal edge further may further include removing a burr adhered to the new distal edge. According to the foregoing feature, another cap may be preferably mounted and bonded onto the sleeve after cutting off the brim and the distal edge.

In the foregoing feature, the step of removing the part of the one cap remaining in the sleeve includes removing the surface. According to the foregoing feature, the subsequent processes such as filling a toner and mounting another cap on the sleeve may be preferably performed.

In the foregoing feature, the recycling method may further comprise measuring a size of the sleeve after the step of removing the area including the interface between the brim part and the leading edge. This feature allows a user to figure out how many times the toner container has been recycled and/or may be recycled in the future.

In the foregoing feature, the one cap further includes a connecting portion extending between the brim and the surface, and the step of removing the surface further includes preparing a tool having a first distal end and a second distal end, the tool configured to be inserted into the sleeve; inserting the tool into the sleeve so that the first distal end and the second distal end come in contact with a the connecting portion; and pulling out the first distal end and the second distal end from the sleeve together with the connecting portion and the surface. Although the foregoing embodiment illustrated a case where the cylindrical insertion part of the cap is used as the connecting portion, the scissor-shaped exclusive tool is used as the tool, and the pair of distal ends of the exclusive tool are used as the first distal end and the second end, the present invention is not limited thereto. For instance, the connecting portion may also be configured from a plurality of plate pieces in any shape for connecting the brim and the surface. Moreover, in substitute for the scissor-shaped exclusive tool, two or more separate L-shaped rods may be used for removing the surface. According to the foregoing feature, the cap, from which the brim is removed, may be easily removed from the sleeve.

In the foregoing feature, the recycling method may further comprise cleaning the inside of the casing before the step of filling a toner in the casing. According to the foregoing feature, the amount of old toner existing in the recycled toner container may be reduced.

In the foregoing feature, the step of cleaning the inside of the casing includes: positioning the distal edge to be lower than a proximal end of the sleeve that is connected with the casing; and discharging air from the inside of the casing. According to the foregoing feature, the discharge of old toner from the inside of the casing may be facilitated by using gravity and the gas that is sent inside the casing.

In the foregoing feature, the step of positioning the distal edge to be lower than the proximal end of the sleeve that is connected with the casing includes preparing a hopper having a first opening configured to receive the sleeve and a second opening below the first opening, and a suction unit connected with the second opening and sucking gas inside the casing, and wherein the step of discharging gas from the inside of the casing includes activating the suction unit for sucking gas inside the casing. Although the foregoing embodiment illustrated a case where the opening positioned at the upper end of the hopper is used as the first opening, and the opening positioned at the lower end of the hopper is used as the second opening, the present invention is not limited to the shape of the hopper depicted in FIG. 6C. According to the foregoing feature, the casing may be stably mounted on the hopper, and a suction apparatus may facilitate the discharge of old toner from the casing.

In the foregoing feature, wherein the step of positioning the distal edge to be lower than the proximal end of the sleeve that is connected with the casing further includes preparing a compressor for generating compressed gas, and a supply pipe including a proximal end configured to be connected with the compressor and a distal end disposed in the casing, and wherein the step of discharging gas from the inside of the casing includes sending compressed gas from the compressor into the casing via the supply pipe. According to the foregoing feature, the old toner adhered to the casing inner wall may be floated inside the casing so as to be easily discharged from the casing.

In the foregoing feature, the step of bonding the new distal edge and the brim of the another cap includes: preparing an ultrasonic wave generator; and melting at least one of the brim of the another cap and the new distal edge with ultrasonic wave energy from the ultrasonic wave generator. According to the foregoing feature, the brim and the distal edge may be preferably bonded together.

In the foregoing feature, the brim may include a protrusion toward the sleeve, and the step of bonding the new distal edge and the brim includes concentrating the energy on the protrusion. According to the foregoing feature, the brim and the distal edge may be efficiently bonded together.

The present invention is not limited to the foregoing embodiment, and also covers the subject matter described below.

(1) Although the foregoing embodiment explained a case where the printer 10 is illustrated as an example of the image formation apparatus to which the toner container 20 is applied, a copy machine or a facsimile device may be used in substitute for the printer 10.

(2) Although the foregoing embodiment explained a case where the ultrasonic wave generator 65 is used for bonding the cap 50 to the sleeve 40 of the toner container 20, high-frequency heating of applying high frequency or microwave heating of applying microwaves may also be used alternatively. In addition, a standard adhesive may be applied to the bonding plane.

(3) Although the foregoing embodiment explained a case where an end mill is used to remove the sleeve 40 and the brim 52, the present invention is not limited thereto, a saw may also be used, for example, to cut sleeve 40 so as to remove the sleeve 40 and the brim 52.

This application is based on Japanese Patent Application Serial No. 2008-265152, filed in Japan Patent Office on Oct. 14, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A method for recycling a toner container including a casing configured to house a toner, a sleeve protruding from the casing, and one cap that has a brim to be bonded with a distal edge of the sleeve to be closed and a body part inserted into the sleeve, comprising:

cutting the sleeve and the body part to remove an area including an interface between the brim and the distal edge and to form a new distal edge on the sleeve;

removing a part of the one cap remaining in the sleeve;

filling the toner in the casing;

fitting a new cap into the sleeve so that the brim of the new cap comes in contact with the new distal edge; and bonding the new distal edge and the brim of the new cap.

2. The method according to claim 1, wherein the one cap includes a surface for plugging the sleeve; and the step of removing the area including the interface between the brim part and the leading edge includes forming the new distal edge in a section defined between the brim part and the surface.

3. The method according to claim 1, wherein the step of removing the area including the interface between the brim and the distal edge includes positioning the distal edge at a position lower than a proximal end of the sleeve that is connected with the casing before cutting out the brim and the distal edge.

4. The method according to claim 1, wherein the step of removing the area including the interface between the brim part and the distal edge further includes removing a burr adhered to the new distal edge.

5. The method according claim 2, wherein the step of removing the part of the one cap remaining in the sleeve includes removing the surface.

6. The method according to claim 1, further comprising;

cleaning the inside of the casing before the step of filling the toner in the casing.

7. The method according to claim 6, wherein the step of cleaning the inside of the casing includes:

positioning the distal edge to be lower than a proximal end of the sleeve that is connected with the casing; and discharging air from the inside of the casing.

8. The method according to claim 1, wherein the step of bonding the new distal edge and the brim of the new cap includes:

preparing an ultrasonic wave generator; and melting at least one of the brim of the new cap and the new distal edge with ultrasonic wave energy from the ultrasonic wave generator.

9. The method according to claim 8, wherein the brim includes a protrusion toward the sleeve, and the step of bonding the new distal edge and the brim of the new cap includes concentrating the energy on the protrusion.

10. A method for recycling a toner container including a casing configured to house a toner, a sleeve protruding from the casing, and one cap, the one cap includes a brim to be bonded with a distal edge of the sleeve to be closed, a surface for plugging the sleeve and a connecting portion extending between the brim and the surface, the method comprising:

removing an area including an interface between the brim and the distal edge to form a new distal edge on the sleeve and forming the new distal edge in a section defined between the brim part and the surface;

removing a part of the one cap remaining in the sleeve, including removing the surface;

filling a toner in the casing;

fitting another cap into the sleeve so that the brim of the another cap comes in contact with the new distal edge; and bonding the new distal edge and the brim of the another cap, and the step of removing the surface further includes:

preparing a tool having a first distal end and a second distal end, the tool configured to be inserted into the sleeve;

inserting the tool into the sleeve so that the first distal end and the second distal end come in contact with the connecting portion; and pulling out the first distal end and the second distal end from the sleeve together with the connecting portion and the surface.

11. A method for recycling a toner container including a casing configured to house a toner, a sleeve protruding from the casing, and one cap with a brim to be bonded with a distal edge of the sleeve to be closed comprising:

removing an area including an interface between the brim and the distal edge to form a new distal edge on the sleeve;

removing a part of the one cap remaining in the sleeve;

cleaning the inside of the casing, the step of cleaning the inside of the casing including positioning the distal edge to be lower than a proximal end of the sleeve that is connected with the casing, preparing a hopper having a first opening configured to receive the sleeve and a second opening below the first opening, connecting a suction unit with the second opening and activating the suction unit for sucking gas inside the casing and thereby discharging air from the inside of the casing filling a toner in the casing;

fitting a new cap into the sleeve so that the brim of the new cap comes in contact with the new distal edge; and bonding the new distal edge and the brim of the new cap.

12. The method according to claim 11, wherein the step of positioning the distal edge to be lower than the proximal end of the sleeve that is connected with the casing further includes preparing a compressor for generating compressed gas, and a supply pipe including a proximal end configured to be connected with the compressor and a distal end disposed in the casing, and wherein the step of discharging gas from the inside of the casing includes sending compressed gas from the compressor into the casing via the supply pipe.

* * * * *